US012644265B2

(12) United States Patent
Randall

(10) Patent No.: US 12,644,265 B2
(45) Date of Patent: Jun. 2, 2026

(54) HYDRO JETTING SYSTEM, APPARATUS AND METHOD

(71) Applicant: Howard Randall, Chicago, IL (US)

(72) Inventor: Howard Randall, Chicago, IL (US)

( * ) Notice: Subject to any disclaimer, the term of this patent is extended or adjusted under 35 U.S.C. 154(b) by 23 days.

(21) Appl. No.: 18/810,762

(22) Filed: Aug. 21, 2024

(65) Prior Publication Data

US 2025/0067033 A1 Feb. 27, 2025

Related U.S. Application Data

(60) Provisional application No. 63/534,494, filed on Aug. 24, 2023.

(51) Int. Cl.
*E03C 1/304* (2006.01)

(52) U.S. Cl.
CPC ..... *E03C 1/304* (2013.01)

(58) Field of Classification Search
CPC . E03C 1/30; E03C 1/302; E03C 1/304; E03C 1/308; E03F 9/00; E03F 9/002; E03F 9/007; B08B 9/027; B08B 9/0433; B08B 9/0495; B08B 9/0497; B08B 2209/00; B08B 2209/02; B08B 2209/027; B08B 2209/032; B08B 2209/04
See application file for complete search history.

(56) References Cited

U.S. PATENT DOCUMENTS 5,988,188 A * 11/1999 Born ..... E03F 9/00 134/22.12
9,856,023 B1 * 1/2018 Baldwin ..... B64D 11/02
2004/0149324 A1 * 8/2004 McCleary ..... B08B 9/043 134/172

* cited by examiner

*Primary Examiner* — David G Cormier
(74) *Attorney, Agent, or Firm* — Amundsen Davis, LLC

(57) ABSTRACT

Systems, methods, and apparatus for using hydro jetting to clear blockages from pipes are provided. Hydro jetter systems include a hydro jetter connector device, a jetter, and a wet dry vacuum. Hydro jetter connector devices include a main body having a tee joint, a drain tube connected to one end of the tee joint, and a jetter tube connected to the opposite end of the tee joint. A vacuum line is connected to the third end of the tee joint that is perpendicular to the first and second ends. The jetter tube has an end cap, and the jetter line from the jetter is inserted into and through the endcap, and extends through the hydro jetter connector device into the drainpipe. Methods of using the hydro jetter systems include connecting the hydro jetter connector device to the drainpipe and powering on the jetter and the wet dry vacuum.

18 Claims, 11 Drawing Sheets

HYDRO JETTING SYSTEM, APPARATUS AND METHOD

FIELD OF THE INVENTION

Systems and methods of the present technology relate to systems, methods, and apparatus for using hydro jetting, particularly in indoor plumbing lines.

DESCRIPTION OF RELATED ART

Pressure hydro jet drain cleaners, or jetters, are a specialized plumbing tool that utilize a high-pressure water jet to clear out build-up and blockages in pipes. Build-up and blockages can occur in any plumbing line, whether it is within a building or in sewage lines outside a building. Build-up and blockage are often caused by an accumulation of debris, such as hair, grease/food waste, foreign objects, or plant roots.

While jetters can be very useful, they also have some drawbacks. For example, there may be backflow of water, particularly if the blockage is not cleared immediately upon first impact of the water from the jetter. Backflow can be particularly problematic in indoor plumbing situations, since backflow may gush out onto cabinets and floors, particularly when used with kitchen or bathroom sinks.

BRIEF DESCRIPTION OF THE DRAWINGS

Specific examples have been chosen for purposes of illustration and description, and are shown in the accompanying drawings, forming a part of the specification.

Figure 1:
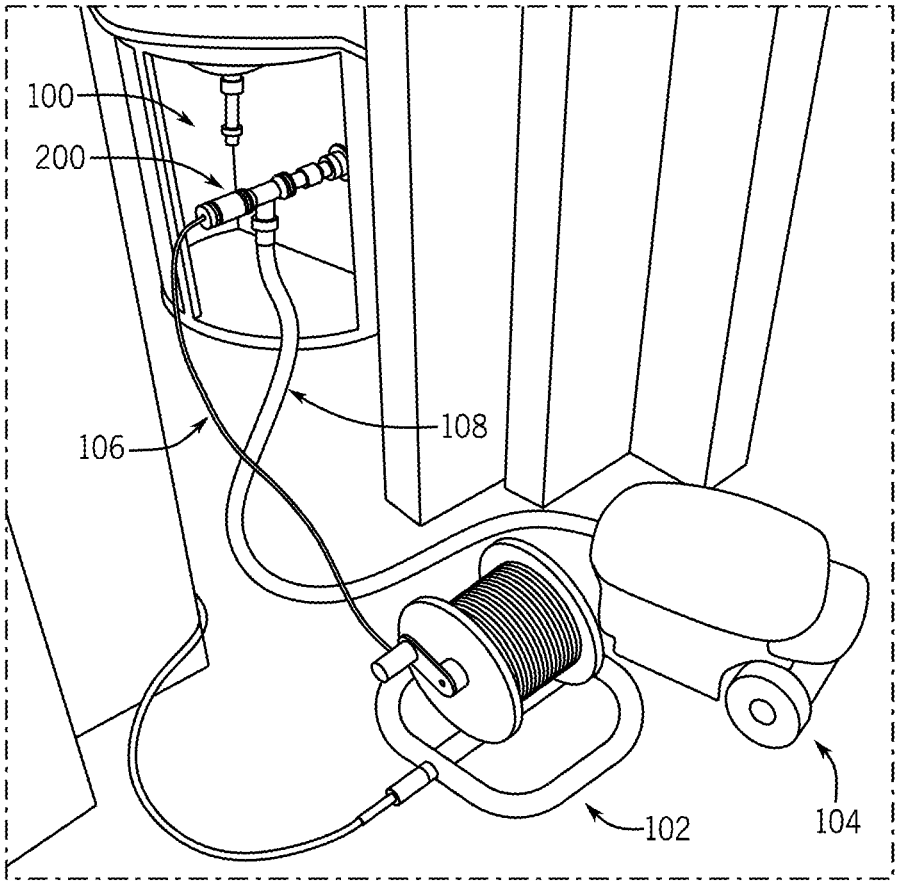
FIG. 1 illustrates one example of a hydro jetter system, including a hydro jetter connector device of the present technology connected to a jetter and a vacuum, connected to the drainpipe of a sink.

While various embodiments discussed herein are amenable to modifications and alternative forms, aspects thereof have been shown by way of example in the drawings and are described in detail herein. It should be understood, however, that the disclosure is not limited to the particular embodiments described, and instead is meant to include all modifications, equivalents, and alternatives falling within the scope of the disclosure. In addition, the terms "example" and "embodiment" as used throughout this application is only by way of illustration, and not limitation, the Figures are not necessarily drawn to scale, and the use of the same reference symbols in different drawings indicates similar or identical items unless otherwise noted. As used herein, the term "about" when referring to dimensions means the stated dimension plus or minus 10%.

DETAILED DESCRIPTION

Figure 2:
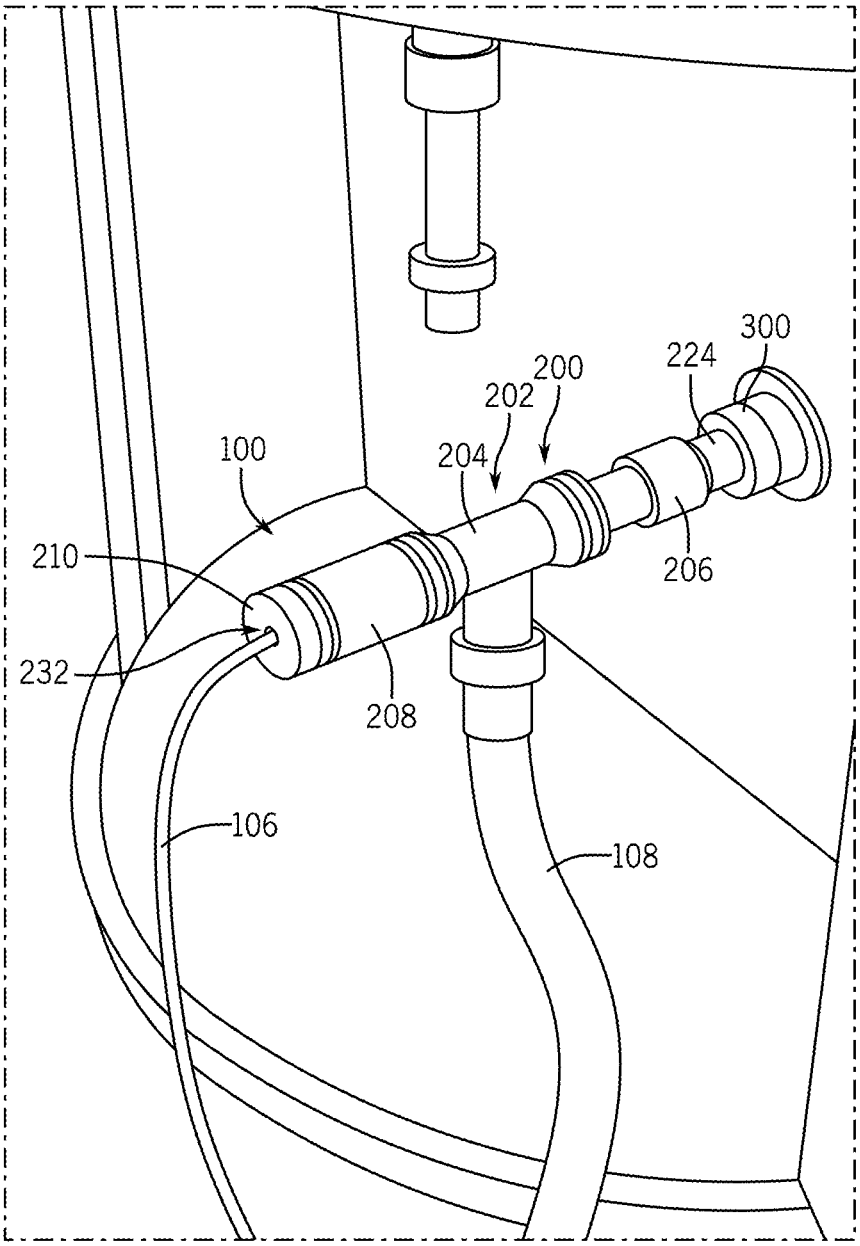
FIG. 2 illustrates the hydro jetter connector device, jetter line, and vacuum line of FIG. 1.
Figure 3:
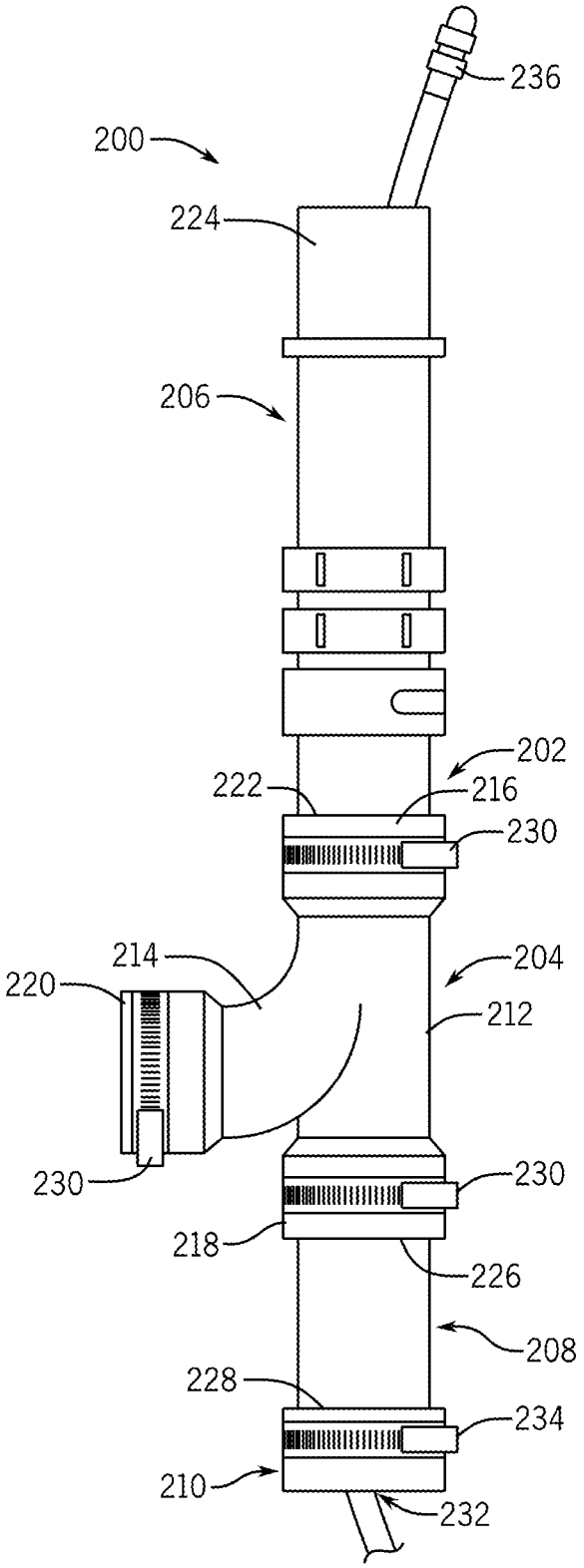
FIG. 3 illustrates one example of a hydro jetter connector device, not connected to a sink, with a jetter line extending therethrough.

FIGS. 1-3 illustrate a one example of a hydro jetter system 100 of the present technology. Hydro jetter systems of the present technology can be used in many settings, including but not limited to plumbing for residences and businesses.

In FIGS. 1 and 2, the hydro jetter system 100 is connected to the drainpipe 300 (see FIG. 2) of a sink (not shown), which in the illustrated example is a bathroom sink. The hydro jetter system 100 includes a hydro jetter connector device 200 of the present technology connected to a jetter 102 and a vacuum 104. The jetter 102 includes a jetter line 106, through which water is ejected at a high pressure when the system is activated. The jetter line 106 is inserted into and extends through the hydro jetter connector device 200 into the drainpipe 300. The vacuum 104 is a wet dry vacuum, commonly called a shop-vac, which has a vacuum line 108 that is connected to the hydro jetter connector device 200.

FIG. 3 illustrates the hydro jetter connector device 200 not connected to a sink. As shown, the hydro jetter connector device 200 includes a main body 202 that includes a tee joint 204, a drain tube 206, a jetter tube 208, and an end cap 210. As shown in FIG. 3, the tee joint 204 includes a primary section 212 and a secondary section 214 that is perpendicular to the primary section. The primary section includes a tee joint first end 216 and a tee joint second end 218 that is opposite the tee joint first end 216. The secondary section 214 includes a tee joint third end 220. The drain tube 206 has a drain tube first end 222 and a drain tube second end 224 opposite the drain tube first end. The drain tube first end 222 is connected to the tee joint first end 216. The drain tube second end 224 is configured to connect to a drainpipe 300, and is shown connected to the drainpipe 300 in FIG. 2. The jetter tube 208 has a jetter tube first end 226 and a jetter tube second end 228 opposite the jetter tube first end. The jetter tube first end 226 is connected to the tee joint second end 218. Clamps and adapters may be used to connect the tee joint 204, drain tube 206 and jetter tube 208, as needed and appropriate. For example, as shown in FIG. 2, the tee joint first end 216, tee joint second end 218, and tee joint third end 220 each include a clamp 230, which may be used to connect and secure the tee joint 204 to the drain tube 206, jetter tube 208, and the vacuum line 108 (FIG. 2). In at least one example, the clamps may be replaced with twist lock connections, or any other suitable connection. Further, any one or more components of hydro jetter connector devices of the present technology may be integrally formed with one or more other of the components.

The hydro jetter connector device 200 also includes the end cap 210, which is connected to the jetter tube second end 228, and may be secured by an end cap clamp 234, which may be the same type of clamp as clamp 230. As shown in FIGS. 2 and 3, the end cap 210 has an end cap opening 232 into which the jetter line 106 is inserted. As shown in FIG. 2, the jetter line 106 is inserted into the end cap opening 232 and extends through the hydro jetter connector device 200. The jetter line 106 ends in a jetter line nozzle 236, which is extended into the drainpipe 300.

Figure 4:
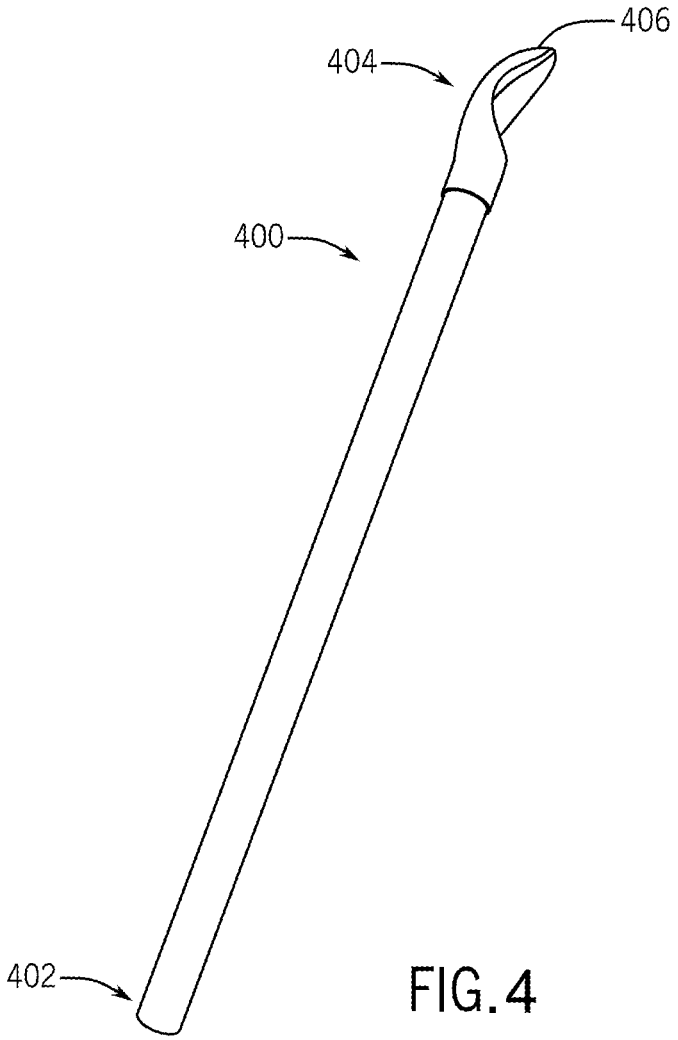
FIG. 4 illustrates one example of a jetter guide tube of the present technology that can be used with a hydro jetter connector device of the present technology.
Figure 5:
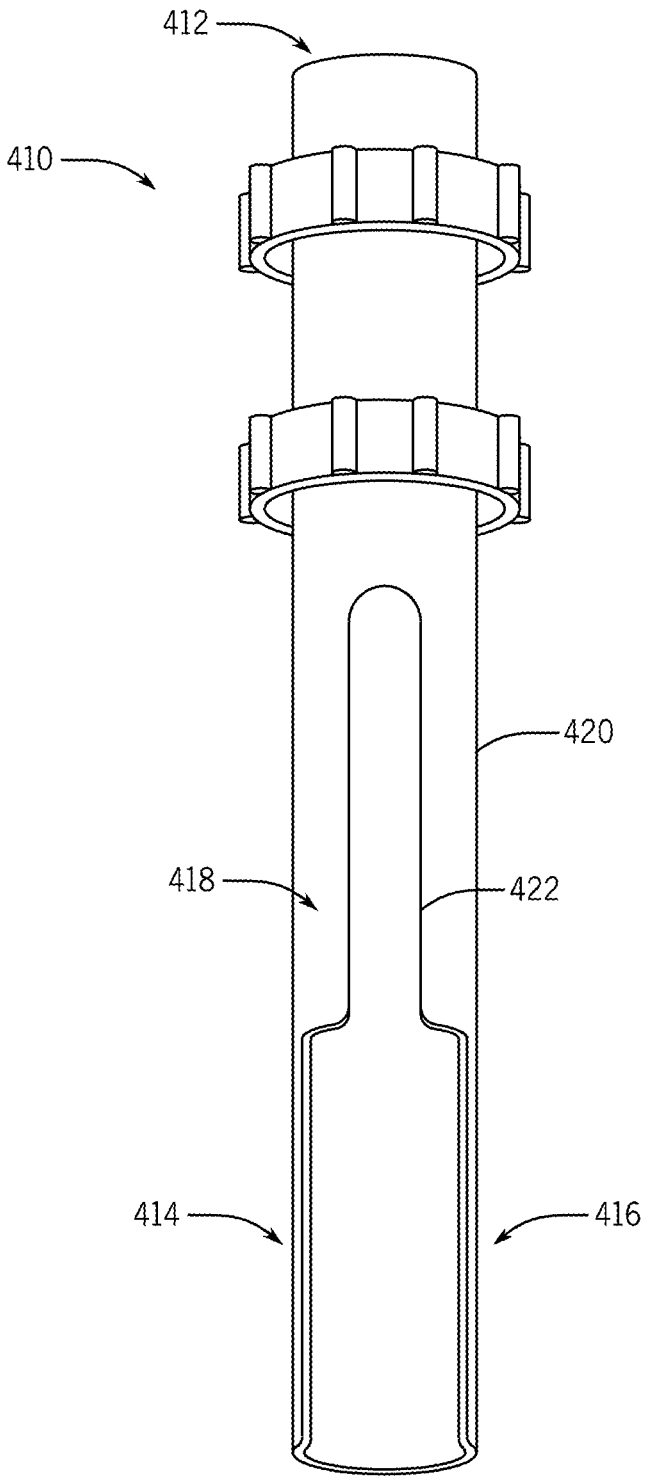
FIG. 5 illustrates a second example of a jetter guide tube of the present technology that can be used with a hydro jetter connector device of the present technology

Referring to FIGS. 4 and 5, the hydro jetter system 100 may also include a jetter guide tube, such as jetter guide tube 400 shown in FIG. 4 or jetter guide tube 410 shown in FIG. 5. The jetter guide tube is an optional component that may be most useful in situations where the plumbing line to be hydro jetted is metal instead of polyvinyl chloride. In such situations, the jetter line 106 and jetter line nozzle 236 may not easily bend to follow the downward bend of most indoor plumbing. The jetter guide tube may guide the jetter line 106 and jetter line nozzle 236 to bend as needed to extend into the drainpipe 300 (FIG. 2).

Referring to FIG. 4, the jetter guide tube 400 has a guide tube first end 402 and a guide tube second end 404. The guide tube second end 404 is the end that extends into the drainpipe 300 (FIG. 2) during use, and includes a curved guide piece 406. Referring to FIGS. 3 and 4, during use, the jetter guide tube 400 extends through the main body 202 of the hydro jetter connector device 200, with the guide tube first end 402 being inserted into the end cap opening 232, and the curved guide piece 406 of the guide tube second end 404 extending beyond the drain tube second end 224 into the drainpipe 300 (FIG. 2). In this example, the jetter guide tube 400 may be made of any suitable material, such as copper.

Referring to FIG. 5, the jetter guide tube 410 has a guide tube first end 412 and a guide tube second end 414. The guide tube second end 414 is the end that extends into the drainpipe 300 (FIG. 2) during use, and includes a guide piece 416. The guide tube second end 410 also includes a split section 418 that forms a partial cylinder 420 with a cut-out notch 422. Referring to FIGS. 3 and 5, during use, the jetter guide tube 410 extends through the main body 202 of the hydro jetter connector device 200, with the guide tube first end 402 being inserted into the end cap opening 232, and the guide piece 416 of the guide tube second end 404 extending beyond the drain tube second end 224 into the drainpipe 300 (FIG. 2). In this example, the jetter guide tube 400 may be made of any suitable material, such as PVC. In the example shown in FIG. 5, the jetter guide tube 410 is formed from a PVC pipe, which may have any suitable diameter, such as a diameter of 1¼ inches or 1½ inches. The the jetter guide tube 410 may have any suitable length, and as shown is about 10 inches long. The split section 418, and correspondingly the cut-out notch 420, may have any suitable length, such as being about 2½ inches long. The cut-out notch 422 may have any suitable width, such as being about ⅛ inches wide. The guide piece 416 may have any suitable length, such as being about 2 inches long. The guide piece 416 may be formed as a portion of a cylinder, such as by removing a portion of the circumference of the PVC pipe when the jetter guide tube 410 is made from a PVC pipe. The jetter guide piece 416 may be formed as a portion of a cylinder that is at least about half the circumference of a cylinder, or greater than half the circumference of a cylinder.

In an alternative example, the jetter guide piece (406 in FIGS. 4 and 416 in FIG. 5) may be connected directly to or integrally formed as part of the drain tube second end 224.

As will be readily understood by one of ordinary skill in the art, plumbing drains and drainpipes may be made of various materials and may be various sizes. For example, the drain tube 206 may have a length that is at least about 6 inches. The jetter tube 208 may have a length that is at least about 4 inches. For example, at least some kitchen sinks have drainpipes that have a nominal diameter (also known as the inner diameter) of 1½ inches, while at least some bathroom sinks have drainpipes that have a nominal diameter of 1¼ inches. In some examples, the first end 216, second end 218, and third end 220 of the tee joint 204 have each have a nominal diameter of 1½ inches. In such examples, the drain tube 206 may have a nominal diameter of 1¼ inches, in order to connect to the sink drainpipe. A reducer adapter, such as reducer adapter 606 in FIG. 6, having one end configured to connect to the drain tube first end 222 having a nominal diameter of 1¼ inches and an opposite end configured to connect to the tee joint first end 216 having a nominal diameter of 1½ inches, may be used to connect the drain tube first end 222 to the tee joint first end 216. Other adapters and connectors may be used as appropriate. Additionally, one or more sections of pipe may be used to form the drain tube 206, which may each have the same or different nominal diameters, and may be connected by at least one adapter.

Components of jetter systems and hydro jetter connector devices of the present technology may be made of any suitable materials. For example, the tee joint 204 and end cap 210 may each be made of rubber. As another example, the drain tube 206 and jetter tube 208 may each be made of plastic, or polyvinyl chloride (PVC). In at least one example, the jetter guide tube 400 may be made of copper or PVC.

Figure 6:
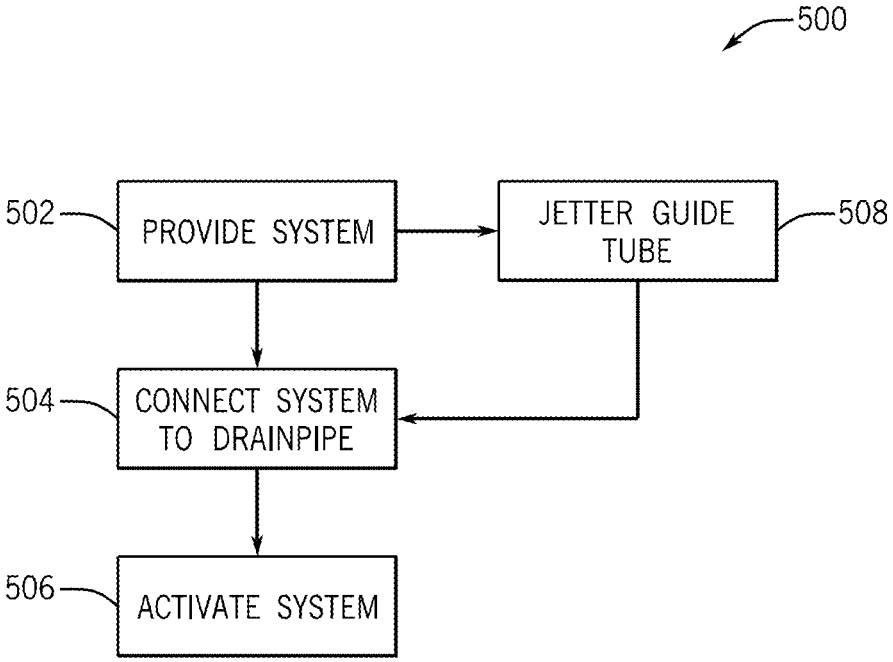
FIG. 6 illustrates one method of using a hydro jetter system of the present technology.

FIG. 6 illustrates one example of a method 500 of using a hydro jetter system of the present technology. The method 500 starts at step 502, which includes providing a hydro jetter system, which may be the hydro jetter system 100 described above. The method proceeds to step 504, which includes connecting the drain tube second end to a drainpipe. The method proceeds to step 506, which includes activating the hydro jetter system by powering on the wet dry vacuum and the jetter. In examples using a jetter guide tube, such as jetter guide tube 400, the method may also include step 508, which includes inserting the jetter guide tube through the hydro jetter connector device. The jetter guide tube may be inserted such that the jetter guide tube extends through the main body, with the guide tube first end being inserted into the end cap opening, and the curved guide piece of the guide tube second end extending beyond the drain tube second end. Step 508 preferably occurs prior to step 504, such that the jetter guide tube is already inserted when the drain tube is connected to the drainpipe.

Below are some examples of hydro jetter connection devices of the present technology, with listings of the components of each. In some examples, the hydro jetter connection device may be provided in kit form, with additional parts, such as adapters and drain tubes of various sizes, for use with pluming of different sizes.

EXAMPLE 1

The following parts were used to assemble a hydro jetter connection device of the present technology for use with a bathroom sink having PVC piping:

A. Tee Joint—Rubber Tee having a diameter at each of the three ends of 1½ inches ""

B. Drain Tube—PVC tube having a diameter of 1¼ inches and a length of 6 inches

C. Adapter—PVC reducer adapter having a diameter at a first end of 1¼ inches and a diameter at a second end of 1½ inches D. Jetter Tube—PVC tube having a diameter of 1½ inches and a length of 6 inches E. End Cap—Rubber cap with a center hole, the rubber cap having a diameter of 1½ inches

EXAMPLE 2

The following parts were used to assemble a hydro jetter connection device of the present technology for use with a kitchen sink having iron piping:

A. Tee Joint-Rubber Tee having a diameter at each of the three ends of 1½ inches inches""

B. Drain Tube-Plastic tube having a diameter of 1½ inches and a length of 6 inches inches C. Jetter Tube-PVC tube having a diameter of 1½ inches and a length of 6 inches D. End Cap-Rubber cap with a center hole, the rubber cap having a diameter of 1½ inches E. Jetter Guide Tube-copper jetter guide tube having a diameter of ¾ inches.

EXAMPLE 3

Figure 7:
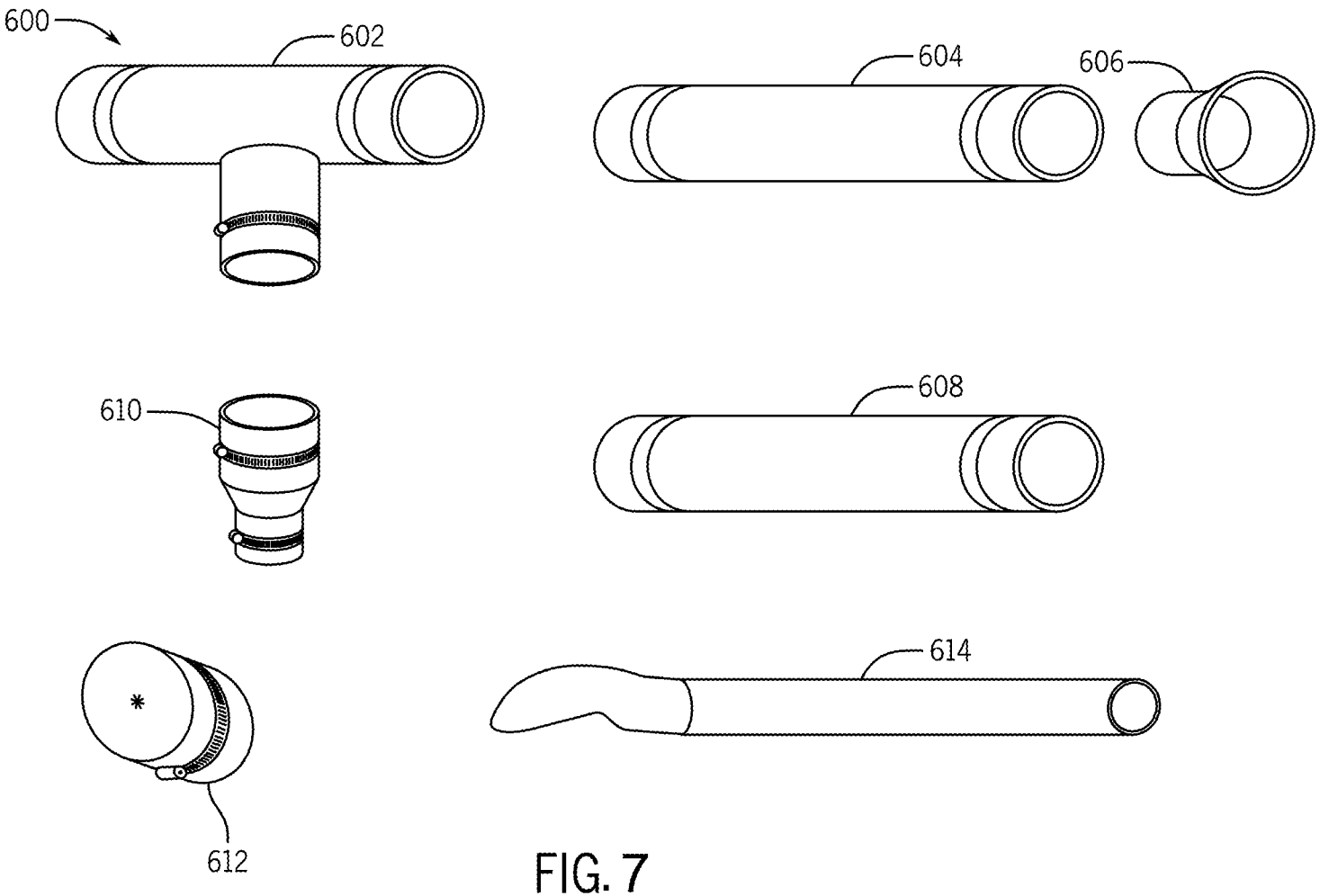
FIG. 7 illustrates the components of one example of a hydro jetter connector device of the present technology.

FIG. 7 illustrates the components of a kit 600 for making a hydro jetter connector device of the present technology, ready to be assembled. As shown, the kit includes: a tee joint 602, which may correspond to element A in Examples 1 and 2 above; a first drain tube 604, which may correspond to element B in Example 1 above; a first reducer adapter 606, which may correspond to element C in Example 1 above; a second drain tube 608, which may correspond to element B in Example 2 above; a second reducer adapter 610, which may be identical to or different from the first reducer adapter 606; and end cap 612, which may correspond to element E in Example 1 above and/or elment D in Example 2 above; and a jetter guide tube 614, which may correspond to element E of Example 2 above [Howard—please review, should this be revised to match FIG. 4? It should be understood that a kit 600 may include any combination of the components shown in FIG. 6 suitable to assemble at least one hydro jetter connector device, and thus may or may not include all of the illustrated components. It should also be understood that first drain tube 604 and second drain tube 608 are interchangeable drain tubes, with first drain tube 604 being a replacement drain tube having different dimensions to accommodate connection to a drainpipe of a different size.

EXAMPLE 4

Figure 8:
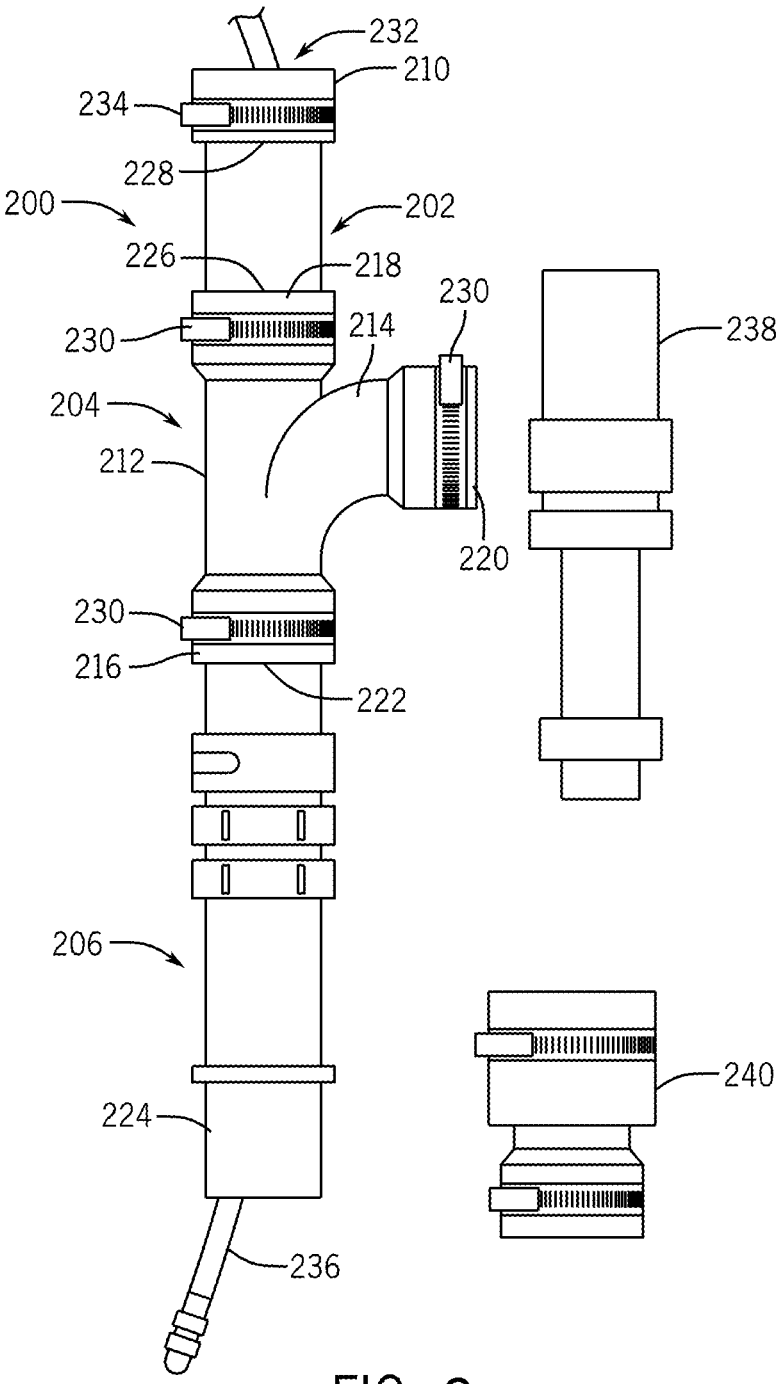
FIG. 8 illustrates one example of a hydro jetter connector device of the present technology with additional optional components, with the jetter line inserted through the hydro jetter connector device.
Figure 10:
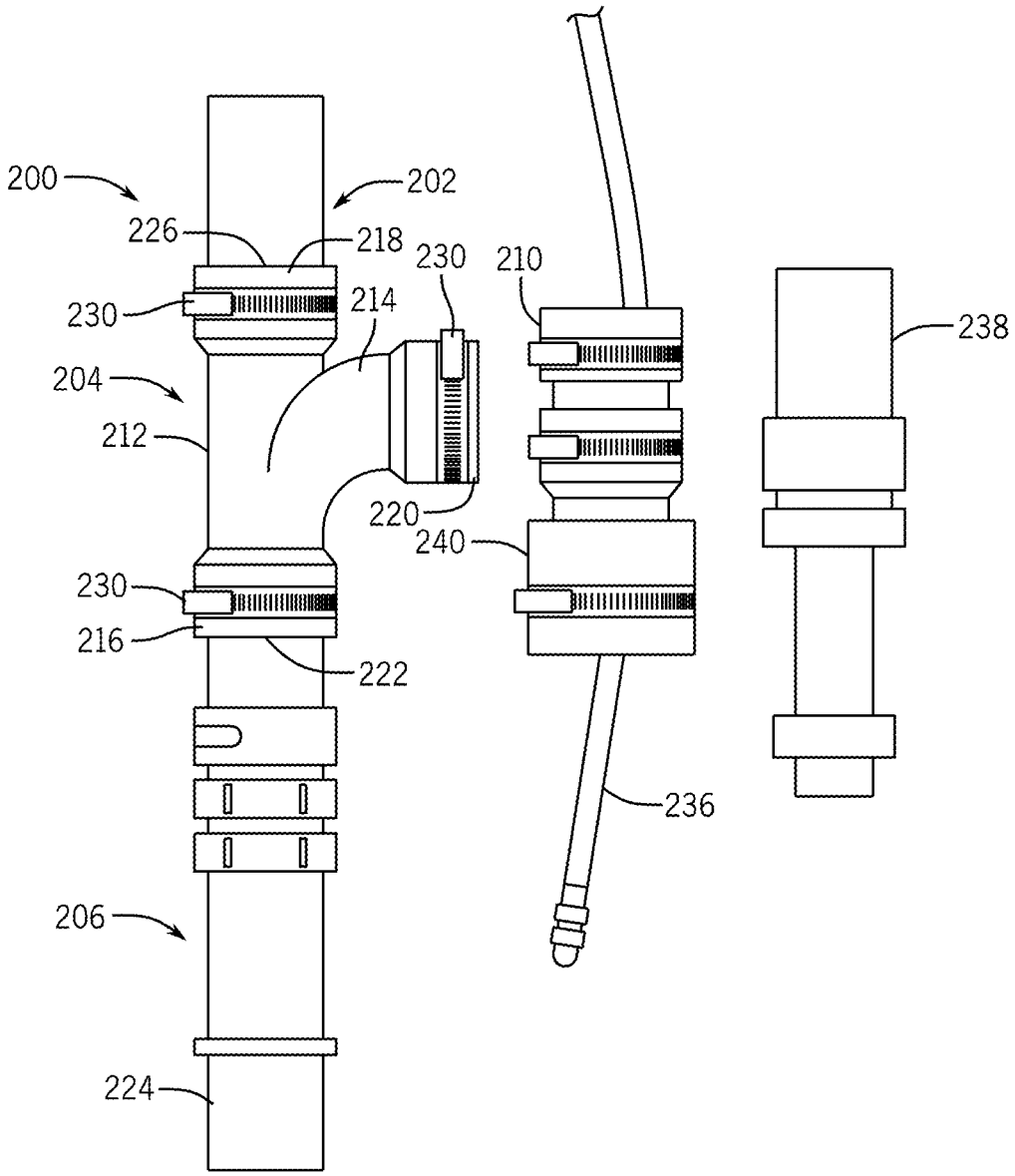
FIG. 10 illustrates the hydro jetter connector device and additional components of FIG. 7, with the end cap removed and attached to a handheld flush tool, and the jetter line inserted through the end cap and handheld flush tool.
Figure 11:
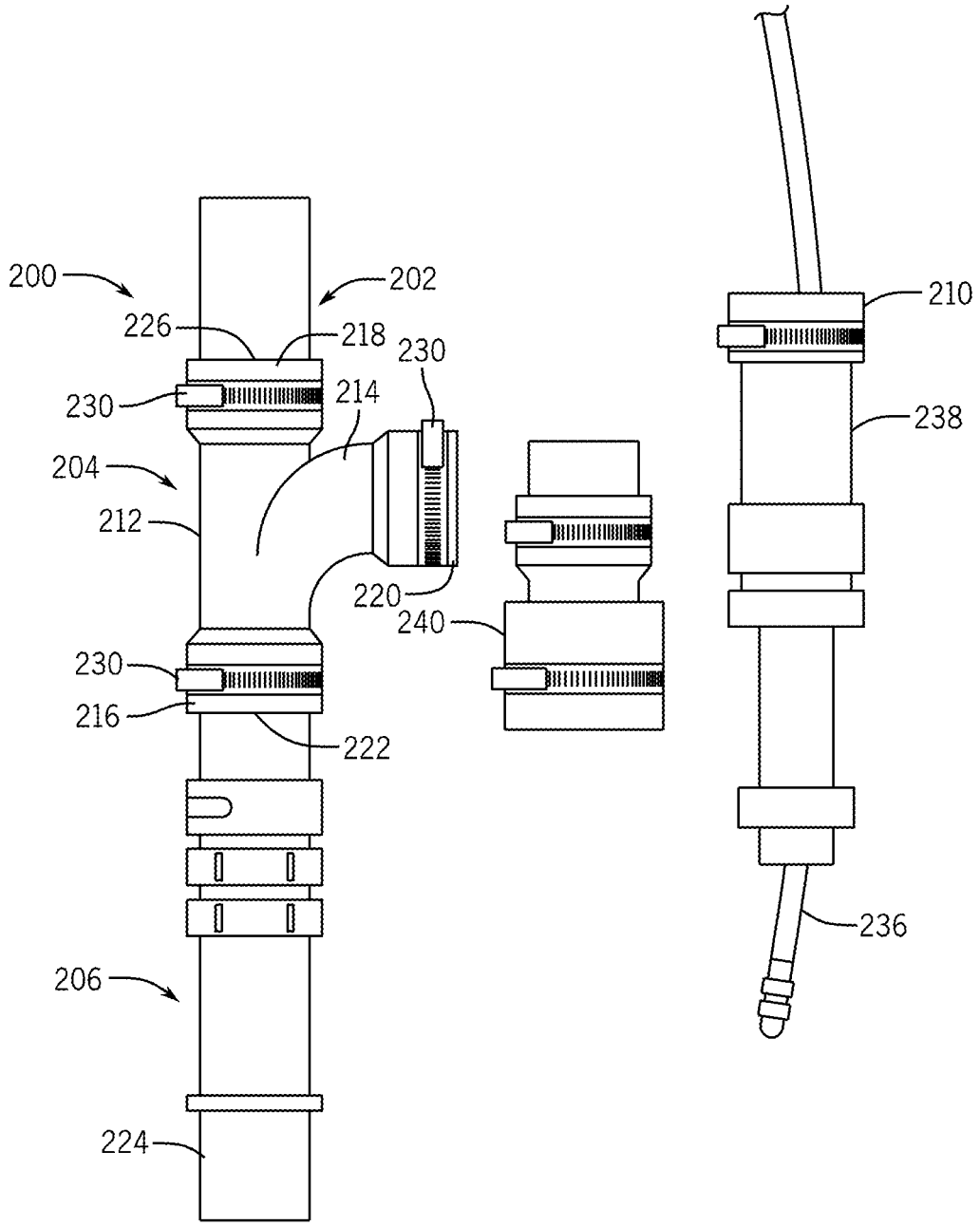
FIG. 11 illustrates the hydro jetter connector device and additional components of FIG. 7, with the end cap installed on a replacement drain tube having different dimensions than the drain tube shown installed on the hydro jetter connector device, and the jetter line inserted through the end cap and replacement drain tube.

FIGS. 8-118-11 illustrate one example of a hydro jetter connector device of the present technology, with an interchangeable replacement drain tube. The hydro jetter connector device 200 has all of the same components described above with respect to FIGS. 2 and 3. The hydro jetter connector device 200 of FIGS. 8-11 also includes two additional components, The additional components include a replacement drain tube 238, which may have different dimensions than the drain tube 206, such as having a different diameter at one end. The other additional component is a handheld flush tool 240 that may be used for sink and tub drains.

As shown in FIG. 8, the hydro jetter connector device 200 has jetter line 236 inserted through the hydro jetter connector device 200.

Figure 9:
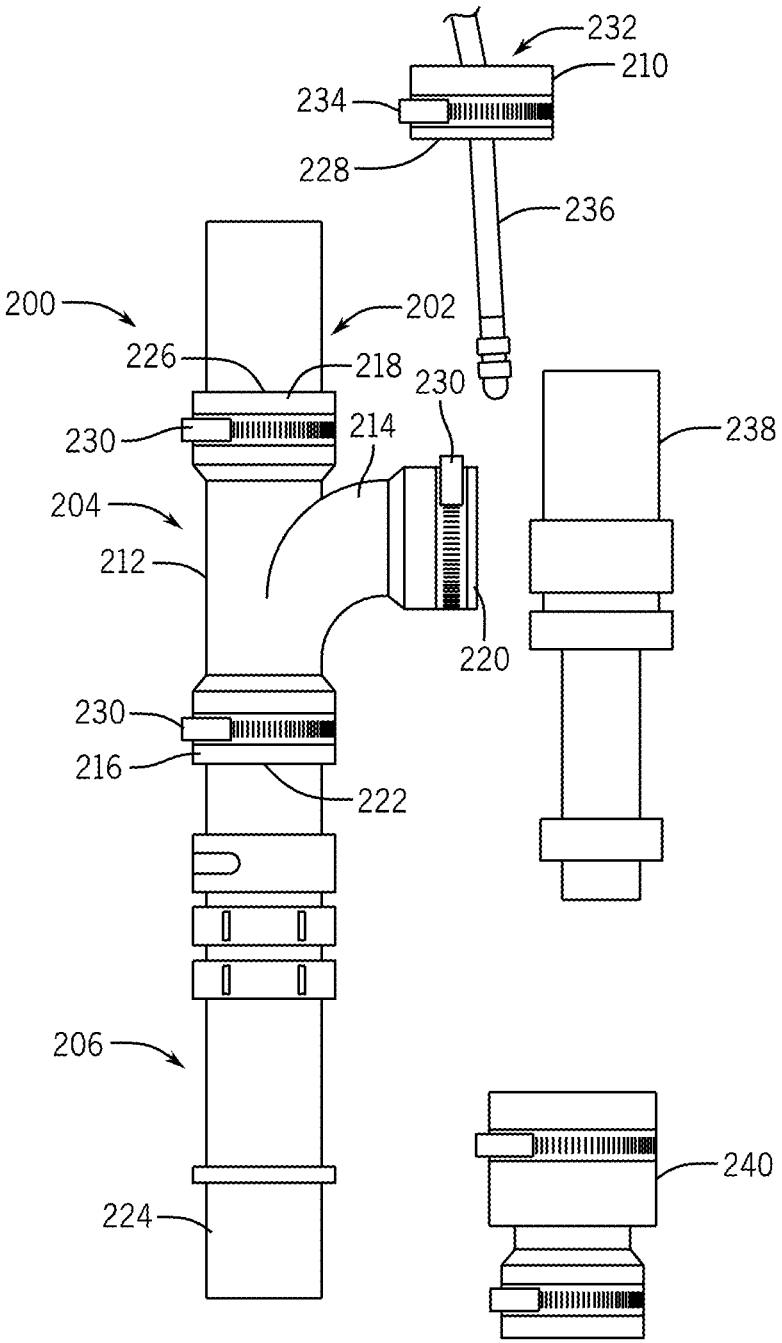
FIG. 9 illustrates the hydro jetter connector device and additional components of FIG. 7, with the end cap removed and the jetter line inserted through the end cap.

As shown in FIG. 9, the end cap 210 is removed from the hydro jetter connector device 200 and the jetter line 236 is inserted through the end cap 210.

As shown in FIG. 10, the end cap 210 is removed from the hydro jetter connector device 200 and connected to the handheld flush tool 240. The jetter line 236 is inserted through the end cap 210 and the handheld flush tool 240. During use, the end cap 210 with the attached handheld flush tool 240 would be reattached to the jetter tube second end 228 of the hydro jetter connector device 200, and the replacement drain tube 238 would not be used.

As shown in FIG. 11, the end cap 210 is removed from the hydro jetter connector device 200 and connected to the replacement drain tube 238. The jetter line 236 is inserted through the end cap 210 and the replacement drain tube 238. During use, the drain tube 206 would be removed, and the replacement drain tube 238 would be installed in place of the drain tube 206 with the end cap 210. The [what] 240 would not be used. The replacement drain tube has different dimensions than the drain tube 206 shown installed on the hydro jetter connector device, specifically, the replacement drain tube has a different diameter at one end.

From the foregoing, it will be appreciated that although specific examples have been described herein for purposes of illustration, various modifications may be made without deviating from the spirit or scope of this disclosure. It is therefore intended that the foregoing detailed description be regarded as illustrative rather than limiting, and that it be understood that it is the following claims, including all equivalents, that are intended to particularly point out and distinctly claim the claimed subject matter.

What is claimed is:

1. A hydro jetter system comprising:

a hydro jetter connector device including:

a main body that includes:

a tee joint, the tee joint having a primary section and a secondary section that is perpendicular to the primary section, the primary section having a tee joint first end and a tee joint second end opposite the tee joint first end, and the secondary section having a tee joint third end;

a drain tube having a drain tube first end and a drain tube second end opposite the drain tube first end, the drain tube first end being connected to the tee joint first end, the drain tube second end being configured to connect to a drainpipe; and a jetter tube having a jetter tube first end and a jetter tube second end opposite the jetter tube first end, the jetter tube first end being connected to the tee joint second end;

an end cap connected to the jetter tube second end, the end cap having an end cap opening into which a jetter line is inserted;

a jetter guide tube having a guide tube first end and a guide tube second end, wherein the jetter guide tube extends through the main body with the guide tube first end being inserted into the end cap opening and the guide tube second end extending beyond the drain tube second end;

a jetter including the jetter line that is inserted into the end cap opening, wherein the jetter line extends through the hydro jetter connector device; and a wet dry vacuum including a vacuum line, wherein the vacuum line is connected to the tee joint third end.

2. The hydro jetter system of claim 1, wherein the guide tube second end includes a curved guide piece, and the curved guide piece of the guide tube second end extending beyond the drain tube second end.

3. The hydro jetter system of claim 1, wherein the drain tube first end is connected to the tee joint first end using a reducer adapter.

4. The hydro jetter system of claim 1, wherein the tee joint and end cap are each made of rubber.

5. The hydro jetter system of claim 1, wherein the drain pipe and jetter tube are made of polyvinyl chloride.

6. The hydro jetter system of claim 1, wherein the jetter guide tube is made of copper.

7. The hydro jetter system of claim 1, wherein the tee joint first end, tee joint second end and tee joint third end each have a nominal diameter of about 1 and ½ inches.

8. The hydro jetter system of claim 1, wherein the drain tube has a length that is about 6 inches.

9. A hydro jetter connector device comprising:

a main body that includes:

a tee joint, the tee joint having a primary section and a secondary section that is perpendicular to the primary section, the primary section having a tee joint first end and a tee joint second end opposite the tee joint first end, and the secondary section having a tee joint third end;

a drain tube having a drain tube first end and a drain tube second end opposite the drain tube first end, the drain tube first end being connected to the tee joint first end, the drain tube second end being configured to connect to a drainpipe; and a jetter tube having a jetter tube first end and a jetter tube second end opposite the jetter tube first end, the jetter tube first end being connected to the tee joint second end; and an end cap connected to the jetter tube second end, the end cap having an end cap opening into which a jetter line is inserted; and a jetter guide tube having a guide tube first end and a guide tube second end, wherein the jetter guide tube extends through the main body with the guide tube first end being inserted into the end cap opening and the guide tube second end extending beyond the drain tube second end.

10. The hydro jetter connector device of claim 9, wherein the guide tube second end includes a curved guide piece, and the curved guide piece of the guide tube second end extending beyond the drain tube second end.

11. The hydro jetter connector device of claim 9, wherein the drain tube first end is connected to the tee joint first end using a reducer adapter.

12. The hydro jetter connector device of claim 9, wherein the tee joint and end cap are each made of rubber.

13. The hydro jetter connector device of claim 9, wherein the drain pipe and jetter tube are made of polyvinyl chloride.

14. The hydro jetter connector device of claim 9, wherein the jetter guide tube is made of copper.

15. The hydro jetter connector device of claim 9, wherein the tee joint first end, tee joint second end and tee joint third end each have a nominal diameter of about 1 and ½ inches.

16. The hydro jetter connector device of claim 9, wherein the drain tube has a length that is about 6 inches.

17. A method of using a hydro jetter system, the method comprising:

providing a hydro jetter system including:

a hydro jetter connector device including:

a main body that includes:

a tee joint, the tee joint having a primary section and a secondary section that is perpendicular to the primary section, the primary section having a tee joint first end and a tee joint second end opposite the tee joint first end, and the secondary section having a tee joint third end;

a drain tube having a drain tube first end and a drain tube second end opposite the drain tube first end, the drain tube first end being connected to the tee joint first end, the drain tube second end being configured to connect to a drainpipe; and a jetter tube having a jetter tube first end and a jetter tube second end opposite the jetter tube first end, the jetter tube first end being connected to the tee joint second end;

an end cap connected to the jetter tube second end, the end cap having an end cap opening into which a jetter line is inserted;

a jetter including the jetter line that is inserted into the end cap opening, wherein the jetter line extends through the hydro jetter connector device; and a wet dry vacuum including a vacuum line, wherein the vacuum line is connected to the tee joint third end;

inserting a jetter guide tube through the a hydro jetter connector device, the jetter guide tube having a guide tube first end and a guide tube second end, wherein the jetter guide tube is inserted such that the jetter guide tube extends through the main body with the guide tube first end being inserted into the end cap opening and the guide tube second end extending beyond the drain tube second end;

connecting the drain tube second end to a drainpipe;

activating the hydro jetter system by powering on the wet dry vacuum and the jetter.

18. The method of claim 17, wherein the guide tube second end includes a curved guide piece, and inserting the jetter guide tube through the a hydro jetter connector device includes the jetter guide tube being inserted such that the curved guide piece of the guide tube second end extending beyond the drain tube second end.

* * * * *